US011718097B2

(12) United States Patent
Fukasawa et al.

(10) Patent No.: US 11,718,097 B2
(45) Date of Patent: Aug. 8, 2023

(54) INK REFILL CONTAINER

(71) Applicant: SEIKO EPSON CORPORATION, Tokyo (JP)

(72) Inventors: Noriyuki Fukasawa, Matsumoto (JP); Hiroyuki Kawate, Hokuto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 20 days.

(21) Appl. No.: 17/577,459

(22) Filed: Jan. 18, 2022

(65) Prior Publication Data

US 2022/0227137 A1 Jul. 21, 2022

(30) Foreign Application Priority Data

Jan. 19, 2021 (JP) ..... 2021-006223
Sep. 21, 2021 (JP) ..... 2021-152990

(51) Int. Cl.
*B41J 2/175* (2006.01)

(52) U.S. Cl.
CPC ..... *B41J 2/17506* (2013.01); *B41J 2/17596* (2013.01)

(58) Field of Classification Search
CPC .... B41J 2/175; B41J 2/17506; B41J 2/17509; B41J 2/17513; B41J 2/17523; B41J 2/17536; B41J 2/17553; B41J 2/17566; B41J 29/02; B41J 29/13; B41J 2002/17573; B41J 2002/17579; B65D 47/123
See application file for complete search history.

(56) References Cited

U.S. PATENT DOCUMENTS

2017/0355194 A1* 12/2017 Fukasawa ..... B41J 2/17509
2020/0307872 A1 10/2020 Nagai et al.

FOREIGN PATENT DOCUMENTS

JP 2016-050007 A 4/2016
JP 2020-164231 A 10/2020

* cited by examiner

*Primary Examiner* — Anh T Vo
(74) *Attorney, Agent, or Firm* — Oliff PLC

(57) ABSTRACT

An ink refill container includes a bottle and a cap. The bottle includes: an ink outlet forming portion having an ink outlet and an outer peripheral portion with a first screw thread; and a valve with a valve member in the ink outlet. The cap includes: a trunk having a second screw thread engageable with the first screw thread; a top portion; and a projection. The projection is configured to move and push the valve member to open the valve member when the cap is rotated in a first direction in which engagement between the first screw thread and second screw thread is cancelled. The projection is configured to relatively rotate in the first direction and move away from the valve member to close the valve member when the cap is rotated in a second direction in which the first screw thread engages with the second screw thread.

5 Claims, 14 Drawing Sheets

INK REFILL CONTAINER

The present application is based on, and claims priority from JP Application Serial Number 2021-006223, filed Jan. 19, 2021 and JP Application Serial Number 2021-152990, filed Sep. 21, 2021, the disclosures of which are hereby incorporated by reference herein in their entirety.

BACKGROUND

1. Technical Field

The present disclosure relates to an ink refill container.

2. Related Art

A known container with a cap has a valve member in the opening through which liquid contents are ejected. The valve member is formed of an elastic material and segmented by slits. JP-A-2016-50007 discloses a cap with a pusher that pushing opens the valve member segmented by the slits.

An environmental change such as an increase in temperature may increase the inner pressure of the container. In such a case, when the container is turned upside down to eject the contents, the sum of the inner pressure and the hydraulic head pressure of the contents may exceed the pressure resistance of the valve member segmented by the slits and the contents may spurt. The cap in JP-A-2016-50007 pushing opens the slit valve with the pusher, but this does not sufficiently release the pressure from the container. Furthermore, when the cap in JP-A-2016-50007 is closed, the pusher keeps the valve member segmented by the slits open. This may result in creep deformation of the valve member. To solve the problem, there is a desire to develop a technology that reduces an increase in pressure in the container and reduces creep deformation of the valve member.

SUMMARY

According to an aspect of the present disclosure, an ink refill container includes a bottle configured to store ink and a cap detachably attached to the bottle. The bottle includes: an ink outlet forming portion that has a tubular ink outlet and an outer peripheral portion having a first screw thread; and a valve that is in the ink outlet and has a valve member. The cap includes: a tubular trunk that has a first inner peripheral portion having a second screw thread configured to engage with the first screw thread; a top portion that faces the ink outlet with the cap being attached to the bottle; and a projection that extends along a center axis of the trunk. The projection is configured to move toward the valve and push the valve member to open the valve when the cap is rotated in a first direction in which engagement between the first screw thread and the second screw thread is cancelled. The projection is configured to relatively rotate in the first direction and move away from the valve member to close the valve when the cap is rotated in a second direction in which engagement between the first screw thread and the second screw thread is established.

According to another aspect of the present disclosure, an ink refill container is provided. The ink refill container includes a bottle configured to store ink and a cap detachably attached to the bottle. The bottle includes: an ink outlet forming portion that has a tubular ink outlet and an outer peripheral portion having a first screw thread; and a valve that includes a valve member formed of an elastic material and disposed in the ink outlet. The valve member is segmented by at least one slit. The cap includes: a tubular trunk that has a first inner peripheral portion having a second screw thread configured to engage with the first screw thread; a top portion that faces the ink outlet with the cap being attached to the bottle; and a projection that extends along a center axis of the trunk. The projection is configured to move toward the valve member until the projection pushes the valve member and enters the slit to open the valve member when the cap is rotated in a first direction in which engagement between the first screw thread and the second screw thread is cancelled. The projection is configured to relatively rotate in the first direction and move away from the valve member to close the valve member when the cap is rotated in a second direction in which engagement between the first screw thread and the second screw thread is established.

The valve of the ink refill container may further include a sealing member in the ink outlet and a spring configured to urge the valve member toward the sealing member.

DESCRIPTION OF EXEMPLARY EMBODIMENTS

A: Embodiment

A1: Overall Structure of Recording Apparatus

Figure 1:
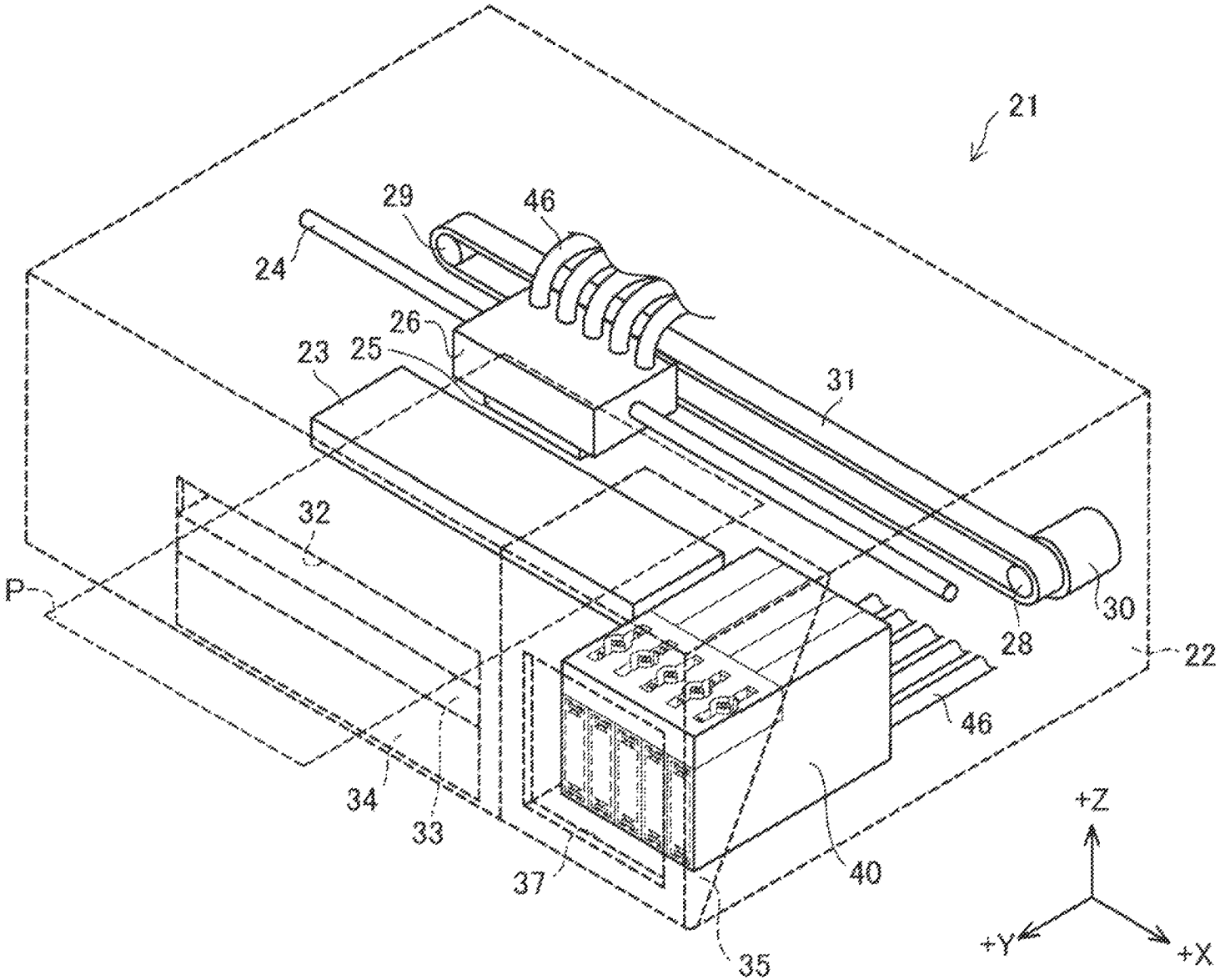
FIG. 1 is a perspective view schematically illustrating a structure of a recording apparatus.

FIG. 1 is a perspective view schematically illustrating a structure of a recording apparatus 21 according to an embodiment. The recording apparatus 21 is an ink jet printer that ejects ink onto a medium to record, for example, an image on the medium. In FIG. 1, X, Y, and Z directions perpendicular to each other are indicated. The X and Y directions extend in the horizontal direction. The Z direction extends in the vertical direction. The X direction includes a +X direction and a −X direction oppositely directed. The Y direction includes a +Y direction and a −Y direction oppositely directed. The Z direction includes a +Z direction and a −Z direction oppositely directed. The +Z direction may be referred to as an upward direction. The −Z direction may be referred to as a downward direction.

The recording apparatus 21 includes a housing 22 having a cuboidal shape elongated in the X direction. In the housing 22, a support board 23 elongated in the X direction is disposed at a lower side with the upper surface extending in the substantially horizontal direction. A sheet P, which is an example of the medium, is supported by the upper surface of the support board 23 and transported in the +Y direction, which is a transportation direction. In the housing 22, a guide shaft 24 extending in the X direction is disposed above the support board 23. The guide shaft 24 supports a carriage 26 having a recording head 25, which ejects ink, on the lower surface. The carriage 26 is supported by the guide shaft 24 in the support hole extending through the carriage 26 in the X direction and is movable backward and forward in the X direction relative to the guide shaft 24.

In the housing 22, a driving pulley 28 and a driven pulley 29 are rotatably disposed near the ends of the guide shaft 24. An output shaft of a carriage motor 30 is coupled to the driving pulley 28. An endless timing belt 31 having a portion coupled to the carriage 26 is wound around the driving pulley 28 and the driven pulley 29. When the carriage motor 30 is driven, the carriage 26 is guided by the guide shaft 24 and reciprocated in the X direction, which is a scanning direction relative to the sheet P, by the timing belt 31. During the reciprocating, ink is ejected from the recording head 25, which is on the lower surface of the carriage 26, onto the sheet P that is being transported forward along the upper surface of the support board 23.

The housing 22 has an outlet 32, an outlet tray 33, and a paper feed cassette 34 at a surface facing in the +Y direction. The sheet P recorded with ink ejected from the recording head 25 is discharged through the outlet 32. The sheet P discharged from the housing 22 is supported by the outlet tray 33. The paper feed cassette 34 is disposed below the outlet tray 33 and houses recording sheets P stacked in layers.

The housing 22 has a door 35 in the surface facing in the +Y direction at an end in the +X direction. The door 35 opens and closes about the lower end as an axis of rotation. The door 35 has a window 37 formed of a rectangular transparent member in the surface facing in +Y direction, allowing a user to visually check the inside of the housing 22. Opening the door 35 of the housing 22 exposes an ink refill adaptor 47 of an ink supply unit 40, which will be described later.

In the housing 22 of the recording apparatus 21, the ink supply unit 40 that supplies ink to the recording head 25 is located behind the door 35. The ink in the ink supply unit 40 is supplied through ink supply tubes 46 to the recording head 25. The ink supply tubes 46 extending from the ink supply unit 40 are coupled to ink passages (not illustrated) in the carriage 26 and coupled to the recording head 25 through the ink passages.

Figure 2:
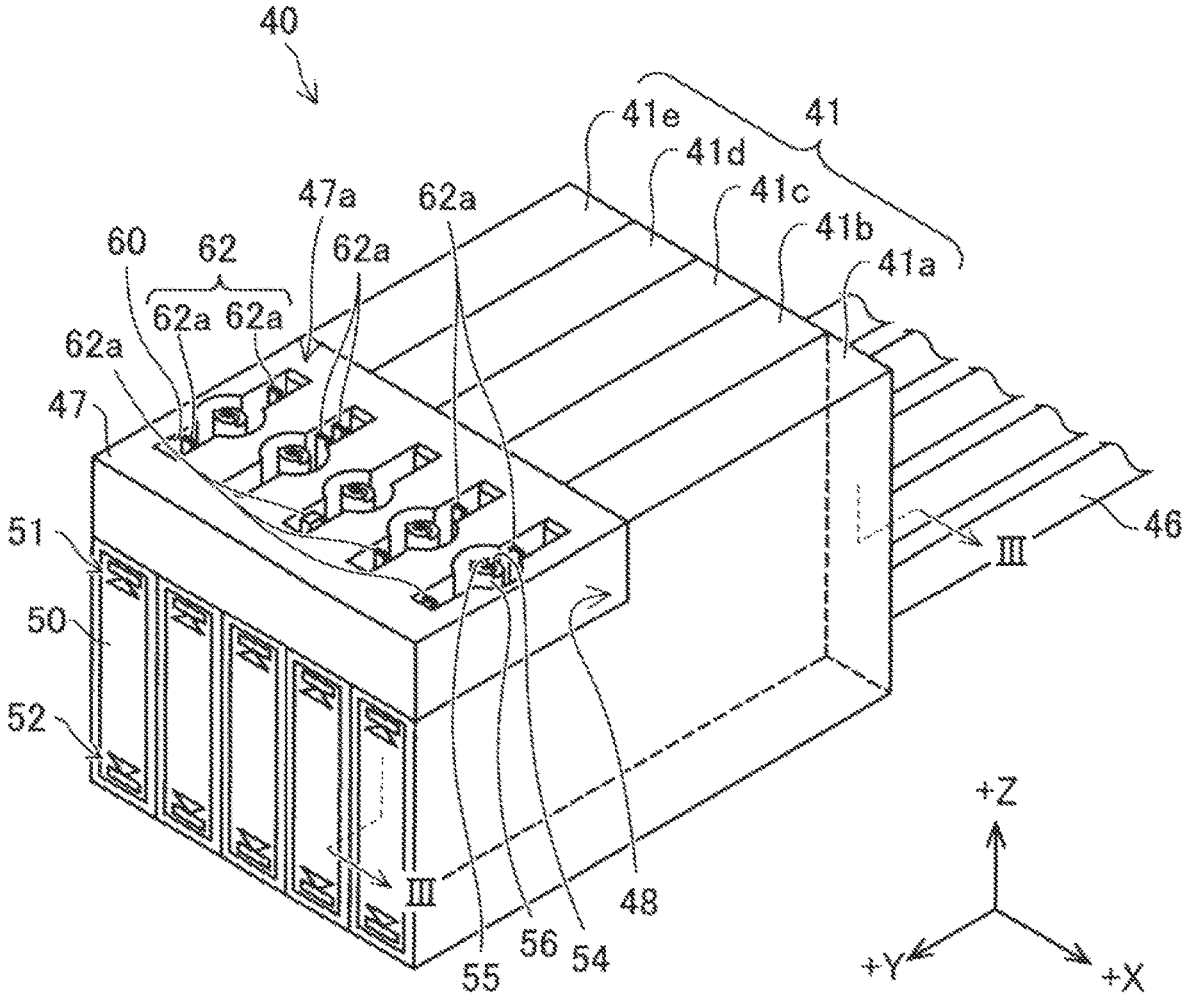
FIG. 2 is a perspective view of an ink supply unit.
Figure 3:
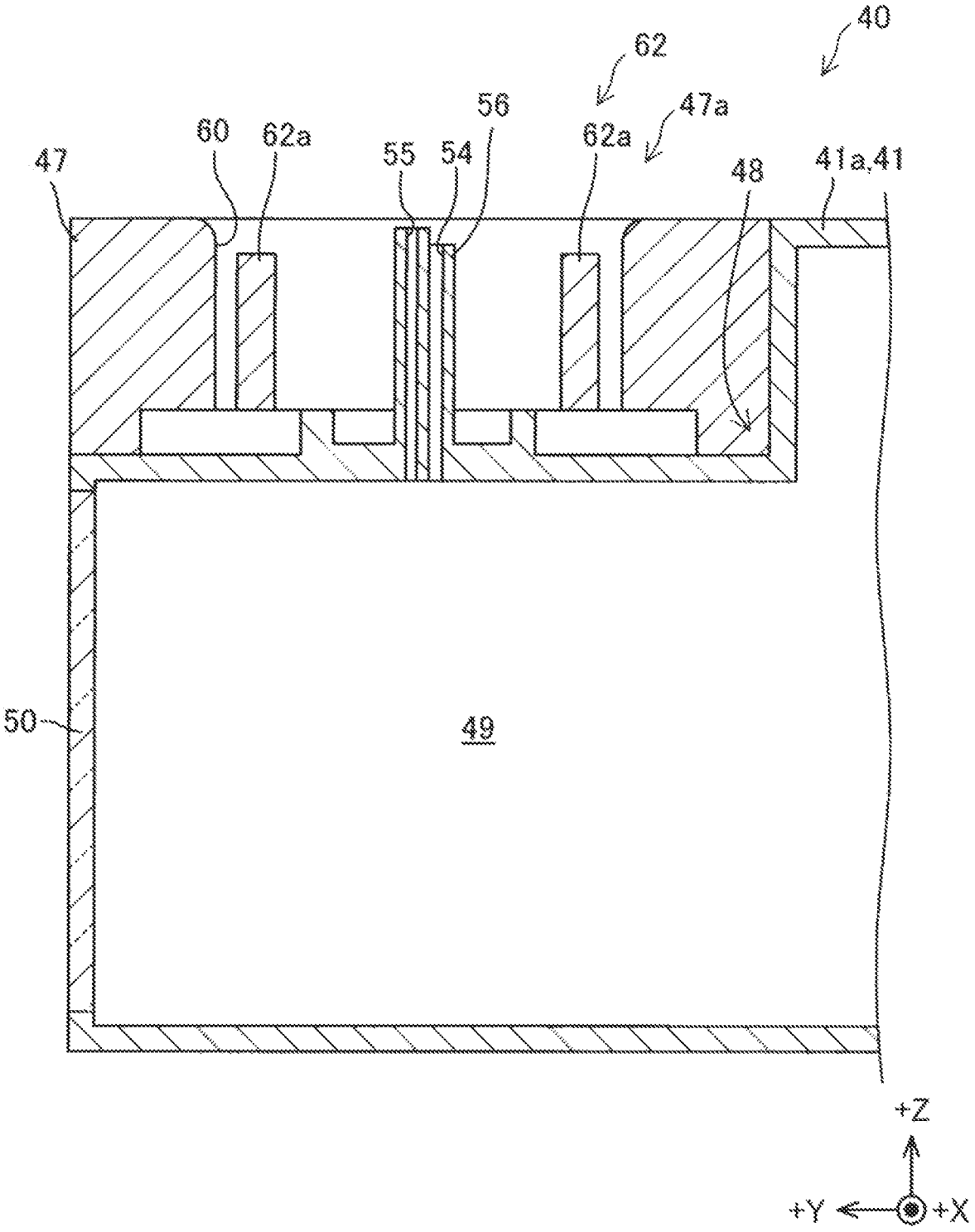
FIG. 3 is a cross-sectional view of the ink supply unit.

FIG. 2 is a perspective view of the ink supply unit 40. FIG. 3 is a cross-sectional view of the ink supply unit 40 taken along line III-III in FIG. 2. As illustrated in FIG. 2, the ink supply unit 40 includes five ink tanks 41*a* to 41*e*, five ink supply tubes 46, and an ink refill adaptor 47. The five ink tanks 41*a* to 41*e* store different colors of ink. Examples of the colors of ink in the ink tanks 41*a* to 41*e* include black, cyan, magenta, and yellow. In the following description, the five ink tanks 41*a* to 41*e* may be collectively referred to as the ink tank 41. The ink tank 41 has a box-like shape elongated in the Y direction and has a cutout portion at an end in the +Z direction and +Y direction. The ink supply tubes 46 are attached to the surface of the ink tank 41 facing in the −Y direction. The cutout portions of the ink tanks 41 are called steps 48. The ink refill adaptor 47 has a cuboidal shape and covers all the steps 48 of the five ink tanks 41*a* to 41*e* arranged in the X direction.

As illustrated in FIG. 3, the ink tank 41 includes an ink storage chamber 49 storing ink, a viewing portion 50, and a needle 56, in addition to the step 48. The viewing portion 50 is a portion of the surface facing in the +Y direction of the ink storage chamber 49 of the ink tank 41 and is formed of a transparent resin. As illustrated in FIG. 2, the viewing portion 50 has an upper limit mark 51 and a lower limit mark 52 that respectively give indications of the upper limit and the lower limit of a liquid level in the ink storage chamber 49. A user can fill the ink storage chamber 49 with ink without letting it overflow by using the upper limit mark 51 as a guide. A user can know the time to supply ink by using the lower limit mark 52 as a guide. The needle 56 has a substantially hollow cylindrical shape extending in the +Z direction from the surface of the step 48 extending in the XY direction. The needle 56 has a first passage 54 and a second passage 55 therein. The space in the needle 56 is separated into the first and second passages 54 and 55. The first and second passages 54 and 55 allow communication between the ink storage chamber 49 and the outside. The upper ends of the first and second passages 54 and 55 are located below the upper surface of the ink refill adaptor 47. In this embodiment, the upper end in the +Z direction of the first passage 54 is located below the upper end in the +Z direction of the second passage 54. However, the first and second passages 54 and 55 may have the same height to make the upper surface of the needle 56 flat.

As illustrated in FIG. 2, the ink refill adaptor 47 includes five ink supply portions 47*a*. The five ink supply portions 47*a* are disposed for the respective five ink tanks 41. As illustrated in FIG. 2, the ink supply portions 47*a* each have a recess 60 and a first concave/convex portion 62. The planar shape of the recess 60 viewed from the +Z direction is a combination of a circular shape and a rectangular shape elongated in the Y direction. The rectangular shape is symmetrical about a center line of the circular shape extending in the Y direction. As illustrated in FIG. 3, the recess 60 extends through the ink refill adaptor 47 in the Z direction and the end in the −Z direction of the recess 60 is closed by the surface of the step 48 extending along the XY plane. The needle 56 is disposed in the recess 60.

The first concave/convex portion 62 is in the recess 60 and includes multiple bars 62*a* each having a rod-like shape extending in the +Z direction. The upper end of each bar 62*a* is located below the upper surface of the ink refill adaptor 47. The bars 62*a* have different cross-sectional shapes and stand at different positions for the different ink tanks 41*a* to 41*e*. Although the bars 62*a* of the ink supply unit 40 have different cross-sectional shapes, the same reference numeral is assigned to all the bars 62*a* for the sake of convenience in this embodiment. The same is applicable to the first concave/convex portions 62. For example, the first concave/convex portion 62 for the ink tank 41*a* has one bar 62*a* adjacent to the needle 56 in the +Y direction and one bar 62*a* adjacent to the needle 56 in the −Y direction. The bar 62*a* adjacent to the needle 56 in the +Y direction is farther away from the needle 56 than the bar 62*a* adjacent to the needle in the −Y direction is. The first concave/convex portion 62 for the ink tank 41*b* also has two bars 62*a*, but the bars 62*a* are away from the needle 56 by a substantially equal distance. The first concave/convex portions 62 for the ink tanks 41*c* to 41*e* are not described, but the first concave/convex portions 62 have the bars 62*a* having different cross-sectional shapes and located at different positions for the different ink tanks 41*c* to 41*e*. During ink refill using the bottle 80, only a bottle 80 that contains ink having a matching color for a refill target, which is any one of the ink tanks 41*a* to 41*e*, fits in the ink refill portion 47*a*, because the first concave/convex portions 62 have different shapes for the different ink tanks 41*a* to 41*e*. The ink refill will be described later in detail.

A2: Structure of Ink Refill Container

Figure 4:
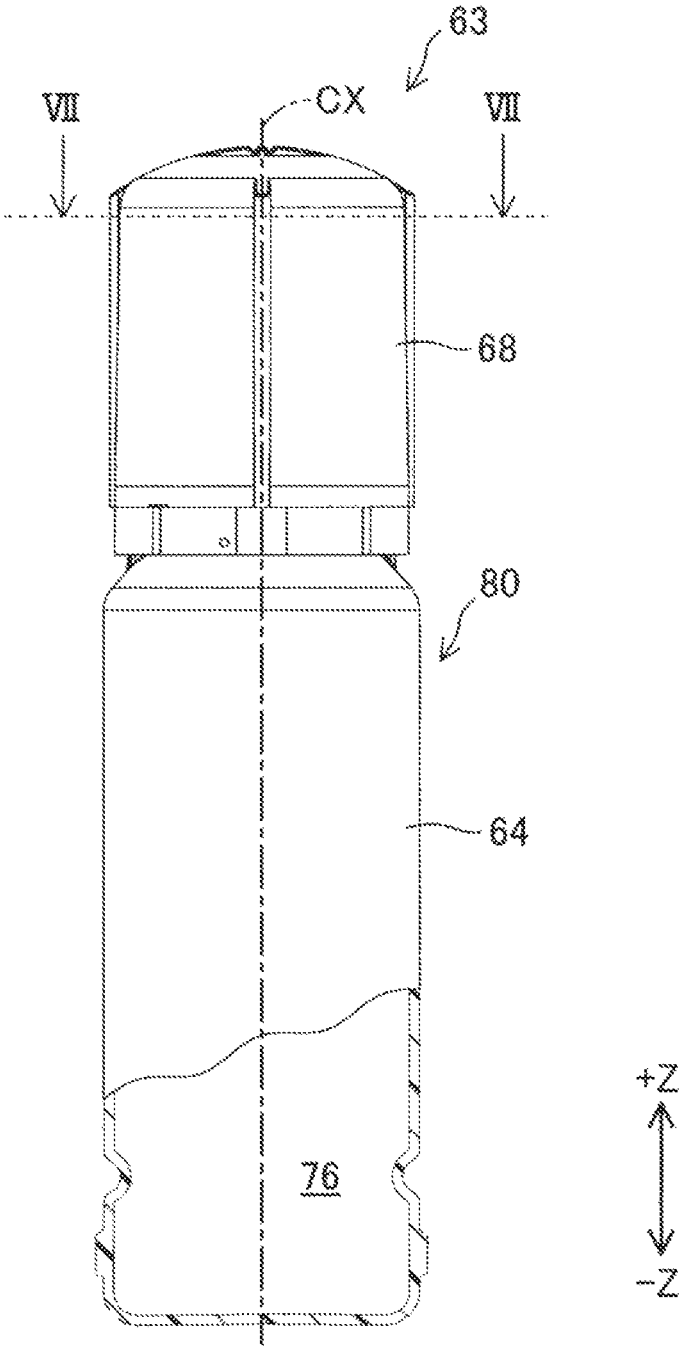
FIG. 4 is a side view of an ink refill container.
Figure 5:
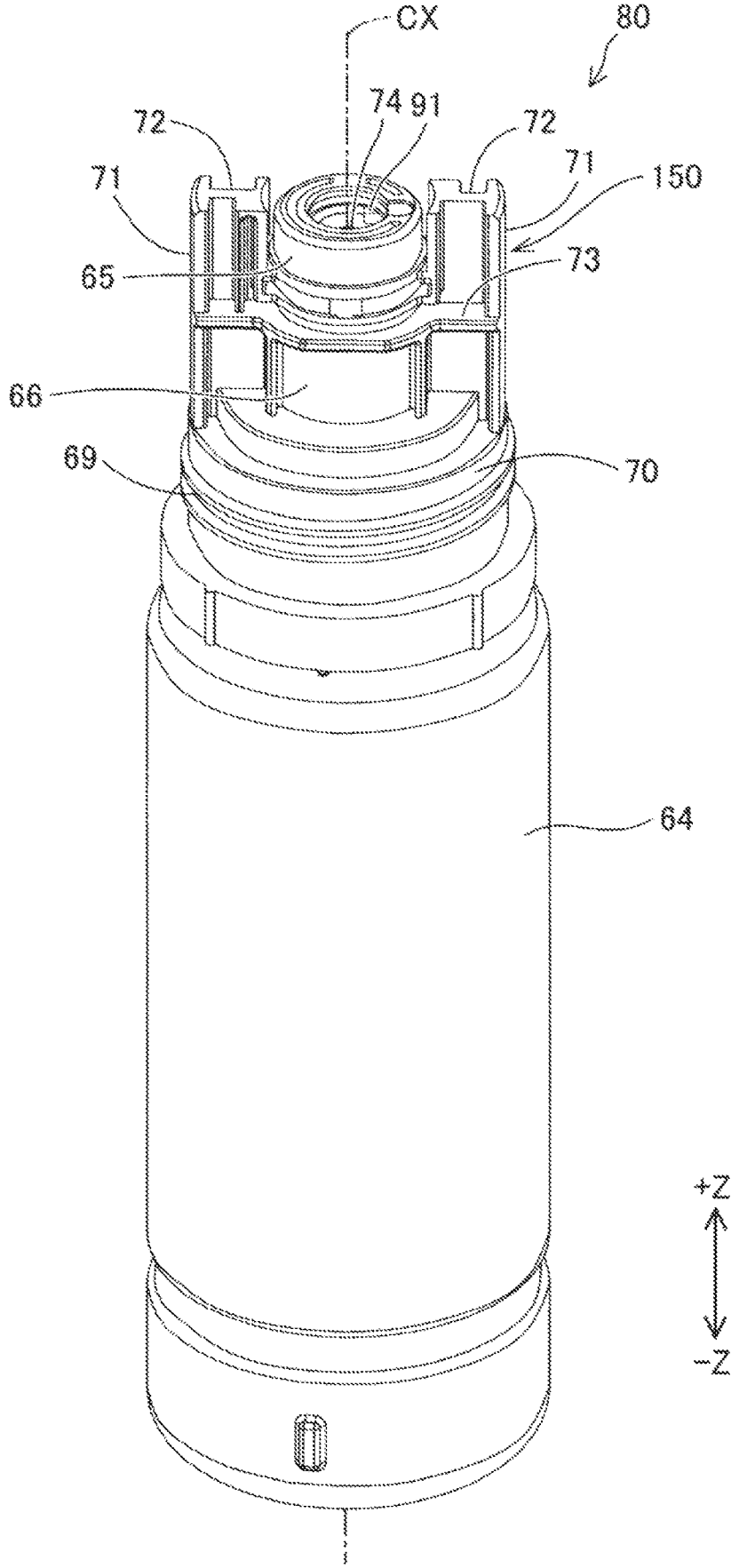
FIG. 5 is a perspective view of a bottle.
Figure 6:
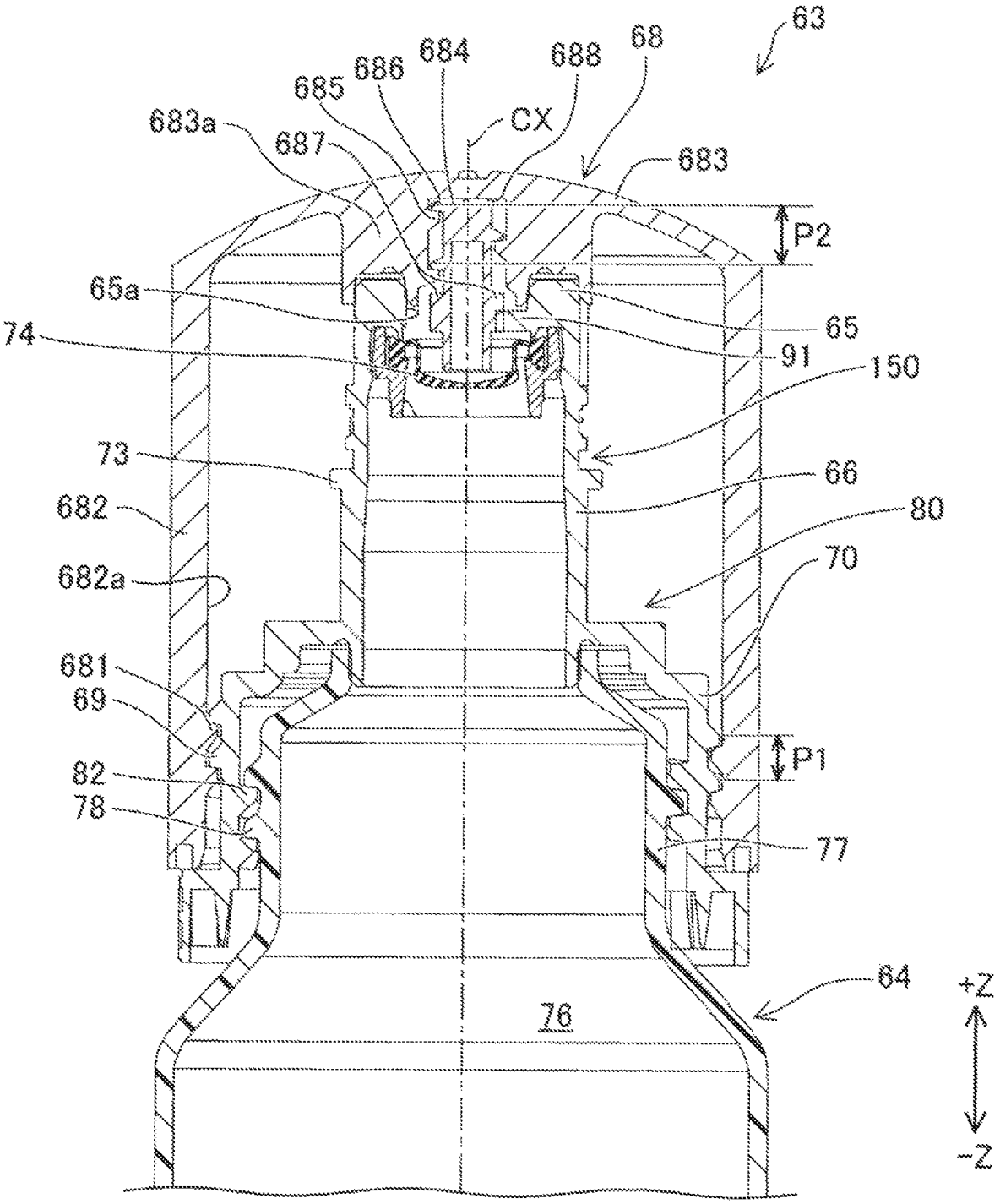
FIG. 6 is a vertical cross-sectional view of a cap and main components of the bottle.
Figure 7:
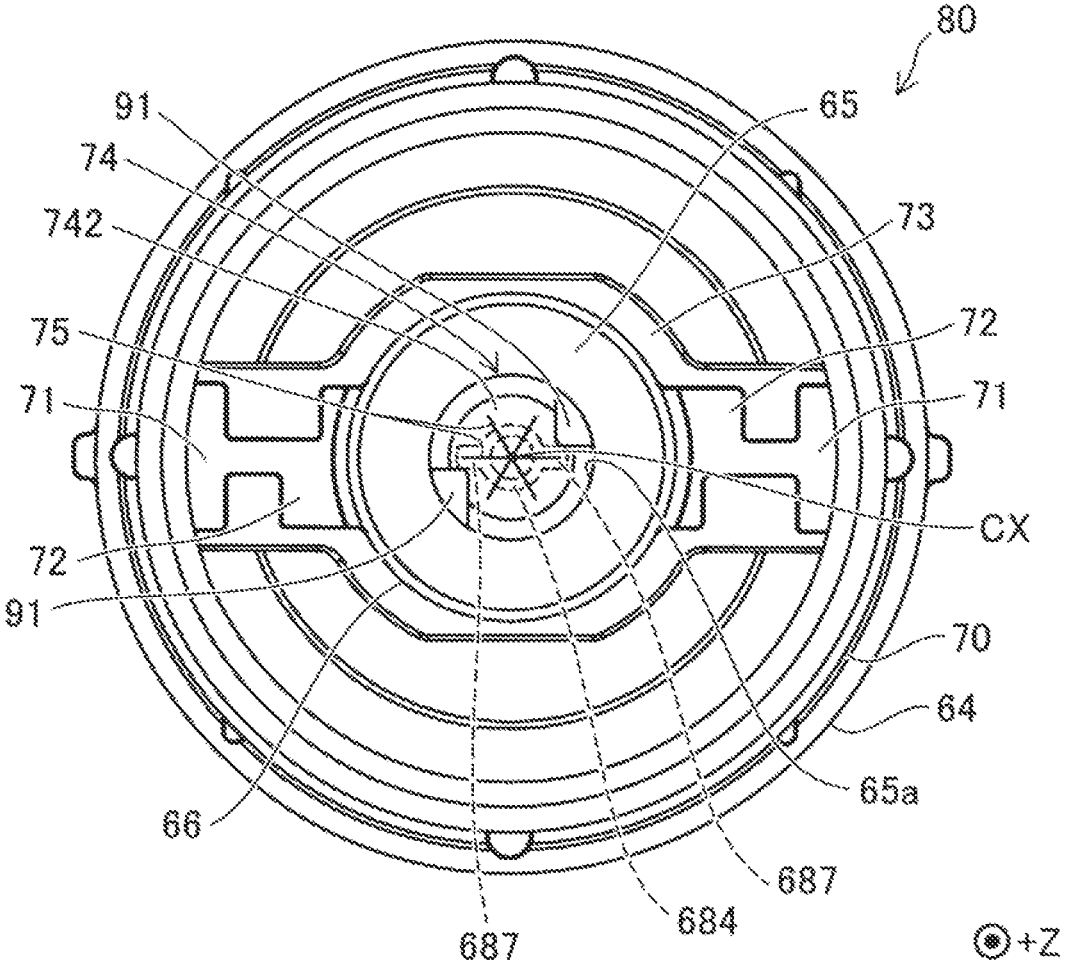
FIG. 7 is a cross-sectional view of a projection and the bottle.

FIG. 4 is a side view of the ink refill container 63. FIG. 5 is a perspective view of the bottle 80. FIG. 6 is a vertical cross-sectional view of the bottle 80. FIG. 7 is a cross-sectional view of a projection 684 and the bottle 80 and is a view taken along line VII-VII in FIG. 4. The ink refill container 63 is used to refill the ink supply unit 40 with ink.

In FIGS. 4 to 7, the Z direction is indicated. The Z direction includes a +Z direction and a −Z direction oppositely directed. The +Z direction may be referred to as an upward direction. The −Z direction may be referred to as a downward direction. As illustrated in FIG. 4, the ink refill container 63 includes the bottle 80 and a cap 68 detachably attached to the bottle 80. The bottle 80 can store ink and has a container body 64 and an ink outlet forming portion 150 as illustrated in FIG. 5.

As illustrated in FIG. 6, the container body 64 has an ink housing 76, a neck 77, and a container screw thread 78. As illustrated in FIG. 4, the container body 64 has a tubular shape with a bottom. The inner space of the container body 64 is the ink housing 76 that stores the ink. The container body 64 is formed of a transparent or semi-transparent material. Examples of the material include polypropylene. As illustrated in FIG. 6, the upper portion of the container body 64 has a smaller diameter. The portion having a smaller diameter is the neck 77. The container screw thread 78 is a male thread on the outer surface of the neck 77.

As illustrated in FIG. 6, the ink outlet forming portion 150 covers the neck 77 of the container body 64 and is detachably attached to the container body 64. The ink outlet forming portion 150 has a substantially hollow cylindrical shape and includes an outer peripheral portion 70, a small-diameter portion 66, an ink outlet 65, a spout screw thread 82, a first screw thread 69, a slit valve 74 as a valve, and a first protrusion 91. The outer peripheral portion 70 is a lower portion of the ink outlet forming portion 150 and has a larger diameter than the neck 77. The outer peripheral portion 70 has the spout screw thread 82 on the inner surface. The spout screw thread 82 is a male thread engaging with the container screw thread 78 on the container body 64. The outer peripheral portion 70 has the first screw thread 69 on the outer surface. The small-diameter portion 66 is located above the outer peripheral portion 70. The small-diameter portion 66 has a smaller inner diameter than the outer peripheral portion 70. The ink outlet 65 having a tubular shape is located on the upper end of the small-diameter portion 66.

In addition to the above, as illustrated in FIG. 5, the ink outlet forming portion 150 has two convex portions 71, two second concave/convex portions 72, and a positioning portion 73. The two convex portions 71 and the two second concave/convex portions 72 are located outwardly from the small-diameter portion 66 in the radial direction. The two convex portions 71 each have a wall extending in the radial direction of the small-diameter portion 66 and a portion extending in the circumferential direction of the small-diameter portion 66 from the leading end in the radial direction of the wall. The two second concave/convex portions 72 extend from the two convex portions 71 in a direction intersecting the walls of the two convex portions 71 or in the circumferential direction of the small-diameter portion 66. The two convex portions 71 extend from the outer peripheral portion 70 in the +Z direction. Specifically described, when viewed in the Z direction, the two convex portions 71 are point symmetrical about the center axis CX and the two second concave/convex portions 72 are point symmetrical about the center axis CX. The two convex portions 71 are configured to fit in the ink refill adaptor 47. The two convex portions 71 each have the second concave/convex portion 72 between the outer end in the radial direction of the small-diameter portion 66 and the inner end adjacent to the small-diameter portion 66. As illustrated in FIG. 7, when viewed in the Z direction, the second concave/convex portion 72 has a cutout in each surface extending in the diametrical direction to fit with the first concave/convex portion 62. The second concave/convex portions 72 have different shapes for different colors of ink in the bottles 80. The second concave/convex portion 72 in FIG. 7 is shaped to fit the first concave/convex portion 62 of the ink tank 41*b*. Specifically described, the second concave/convex portions 72 have predetermined shapes for different colors of ink in the bottles 80. The shapes are designed to fit the first concave/convex portions 62 having predetermined shapes for different ink colors. As illustrated in FIG. 5, the positioning portion 73 is disposed on substantially the center in the Z direction of the small-diameter portion 66. The positioning portion 73 has a ring-shaped portion and portions extending from the ends in the diametrical direction of the ring-shaped portion to the two convex portions 71. As illustrated in FIG. 7, when viewed in the Z direction, the positioning portion 73 has a portion protruding outwardly from the outer edge of each of the small-diameter portion 66, the second concave/convex portion 72, and the convex portion 71. When the bottle 80 is inserted into the ink refill portion 47*a* for ink refill, the positioning portion 73 comes in contact with the upper surface of the ink refill adaptor 47 at the outer edge in the short-side direction of the recess 60 or in the X direction, and thus the bottle 80 is positioned in the direction along the center axis CX.

As illustrated in FIG. 6, the slit valve 74 is disposed in the opening of the ink outlet 65 and is configured to open and close the passage in the ink outlet 65 to control the ink flow. As illustrated in FIG. 7, the slit valve 74 has a valve member 742 formed of an elastic material such as silicone. The valve member 742 has a circular plan shape when viewed in the Z direction and is segmented by at least one slit 75 extending outwardly from the center of the ink outlet 65 in the radial direction. In this embodiment, the valve member 742 is segmented by six slits 75. When receiving no external force, the slits 75 are closed and thus the slit valve 74 is closed. When receiving an external force, the slits 75 of the valve member 742 are pushed and opened and thus the slit valve 74 is opened. As illustrated in FIG. 7, the two first protrusions 91 protrudes inwardly in the radial direction from a second inner peripheral portion 65*a* of the ink outlet 65. The first protrusions 91 are, as illustrated in FIG. 6, located outwardly from the slit valve 74 in the direction along the center axis CX of the ink outlet 65.

As illustrated in FIG. 6, the cap 68 is detachably attached to the ink outlet forming portion 150 to cover the ink outlet forming portion 150. The cap 68 has a trunk 682, a top portion 683, a top protrusion 683*a*, a projection 684, a second screw thread 681, and a third screw thread 685.

The trunk 682 has a tubular shape. The inner diameter of the trunk 682 is larger than the outer diameter of the outer peripheral portion 70. The trunk 682 has a first inner peripheral portion 682*a* facing the ink outlet forming portion 150. The first inner peripheral portion 682*a* has the second screw thread 681 at an end in the −Z direction. The second screw thread 681 is a female thread configured to engage with the first screw thread 69. The top portion 683 covers the end in the +Z direction of the trunk 682. The top portion 683 faces the ink outlet 65 of the bottle 80 with the cap 68 being attached to the ink outlet forming portion 150. The top portion 683 has the third screw thread 685. Specifically described, the top protrusion 683*a* protrudes from a surface of the top portion 683 facing the ink outlet 65 toward the ink outlet 65. The top protrusion 683*a* has a recess extending in the +Z direction along the center axis CX and the recess has the third screw thread 685 on the inner surface.

The projection 684 extends in a direction along the center axis CX of the trunk 682. The projection 684 has a substantially hollow cylindrical shape. The projection 684 is screwed to the cap 68 with the center axis of the projection 684 being along the center axis CX of the top portion 683. The projection 684 has a side wall 688 as an outer surface, a fourth screw thread 686, and two second protrusions 687. The fourth screw thread 686 is a male thread on an end in the +Z direction of the side wall 688 and is configured to engage with the third screw thread 685. The two second protrusions 687 protrude in the radial direction from an end in the −Z direction of the side wall 688. The engagement of the fourth screw thread 686 with the third screw thread 685 allows the projection 684 to move in the direction along the center axis CX relative to the cap 68.

In this embodiment, the first screw thread 69 and the second screw thread 681 are engaged with each other by clockwise rotation of the cap 68 relative to the bottle 80, which is called a right-hand thread. The third screw thread 685 and the fourth screw thread 686 are engaged with each other by counterclockwise rotation of the cap 68 relative to the projection 684, which is called a left-hand thread. The pitch P2 of the third and fourth screw threads 685 and 686 is larger than the pitch P1 of the first and second screw threads 69 and 681. This makes the movement distance of the projection 684 larger for the rotated amount of the cap 68 than a configuration in which the pitch P1 and the pitch P2 are the same.

As illustrated in FIG. 7, when viewed in the Z direction, the two first protrusions 91 are point symmetrical about the center axis CX. The first protrusions 91 each have two wall surfaces that form a substantially right angle. The two second protrusions 687 of the projection 684 are on both sides of the center axis CX and on the same line passing through the center axis CX. The second protrusions 687 each have two wall surfaces substantially parallel to each other. When the second screw thread 681 of the cap 68 engages with the first screw thread 69 of the bottle 80, one of the two first protrusions 91 and one of the two second protrusions 687 are in contact with each other. In addition, the other of the two first protrusions 91 and the other of the two second protrusions 687 are in contact with each other. This does not allow the projection 684 to rotate relative to the bottle 80 when the cap 68 is rotated relative to the bottle 80 in any of the clockwise direction and the counterclockwise direction.

A3: Ink Refill Using Ink Refill Container

When the amount of ink in the ink tank 41 is small, the user refills the ink tank 41 with ink by using the ink refill container 63. Specifically described, first, the user removes the cap 68 from the ink refill container 68 to expose the ink outlet forming portion 150. The movement of the projection 684 during the removal of the cap 68 from the ink refill container 63 will be described.

Figure 8:
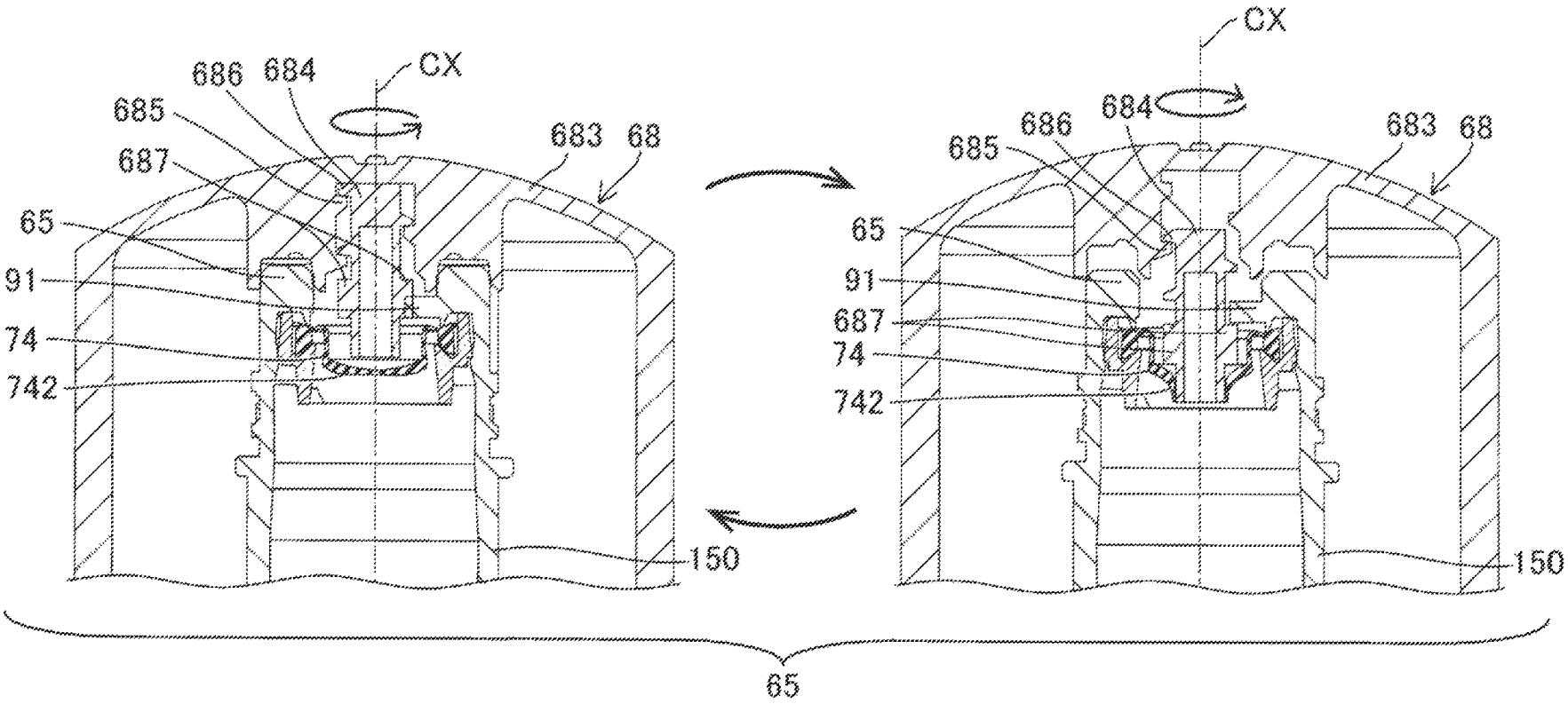
FIG. 8 is a view for explaining a change in position of the projection.

FIG. 8 is a view for explaining how the position of the projection 684 relative to the top portion 683 changes when the cap 68 is attached or detached. In the left view in FIG. 8, the cap 68 is attached to the ink outlet forming portion 150. In the right view in FIG. 8, the cap 68 is unscrewed from the ink outlet forming portion 150. When the cap 68 screwed to the ink outlet forming portion 150 is rotated relative to the ink outlet forming portion 150 in the counterclockwise direction or a first direction in which the engagement between the first and second screw threads 69 and 681 is cancelled, the first and second screw threads 69 and 681 are disengaged from each other. During the rotation of the cap 68 in the counterclockwise direction, the second protrusion 687 of the projection 684 comes in contact with the first protrusion 91, restricting the rotation of the projection 684 about the center axis CX. Then, the contact between the second protrusion 687 and the first protrusion 91 allows relative rotation of the projection 684 in the clockwise direction or the second direction opposite to the first direction. The relative rotation allows the projection 684 to move toward the valve member 742, and the projection 684 pushes the valve member 742 and enters the slit 75. Specifically described, the rotation of the third screw thread 685 in the counterclockwise direction guides the fourth screw thread 686 to the thread groove of the third screw thread 685. This moves the projection 684 toward the valve member 742. As illustrated in the right view in FIG. 8, the projection 684 opens the slit valve 74 and releases the pressure from the ink container 76.

In contrast, when the cap 68 is rotated in the clockwise direction or the second direction in which engagement between first screw thread 69 and the second screw thread 681 is established, the first and second screw threads 69 and 681 are engaged. When the cap 68 is rotated in the clockwise direction, in which engagement between the first and second screw threads 69 and 681 is established, the second protrusion 687 comes in contact with the first protrusion 91. The contact allows the projection 684 to relatively rotate in the first direction and move away from the valve member 742. The valve member 742 is closed when the projection 684 is moved away from the valve member 742. As illustrated in the left view in FIG. 8, with the cap 68 being attached to the ink outlet forming portion 150, the projection 684 does not deform the valve member 742, and thus the valve member 742 is unlikely to be subjected to creep deformation. If the valve member 742 is subjected to creep deformation, ink may drip from the valve member 742 when the bottle 80 is turned upside down. The suppression of creep deformation of the valve member 742 reduces the ink dripping from the bottle 80 turned upside down.

In the ink refilling using the ink refill container 63, after removing the cap 68 from the bottle 80, the user turns the bottle 80 upside down and puts the exposed convex portions 71 of the bottle 80 in the recess 60 of the ink supply unit 40. At this time, if the inner pressure of the ink container 76 is high and the inner pressure of the ink container 76 is not sufficiently released, the sum of the inner pressure and the hydraulic head pressure of the ink would exceed the pressure resistance of the valve member 742 when the bottle 80 is turned upside down. In such a case, the ink may spurt. For example, the pressure in the ink refill container 63 increases if the temperature has increased since the last time the cap 68 was being attached. However, in this embodiment, as described above, the projection 684 enters the valve member 742 to release the pressure from the ink refill container 63 when the cap 68 is removed from the bottle 80. Thus, the ink is unlikely to spurt when the ink refill container 63 is turned upside down.

Figure 9:
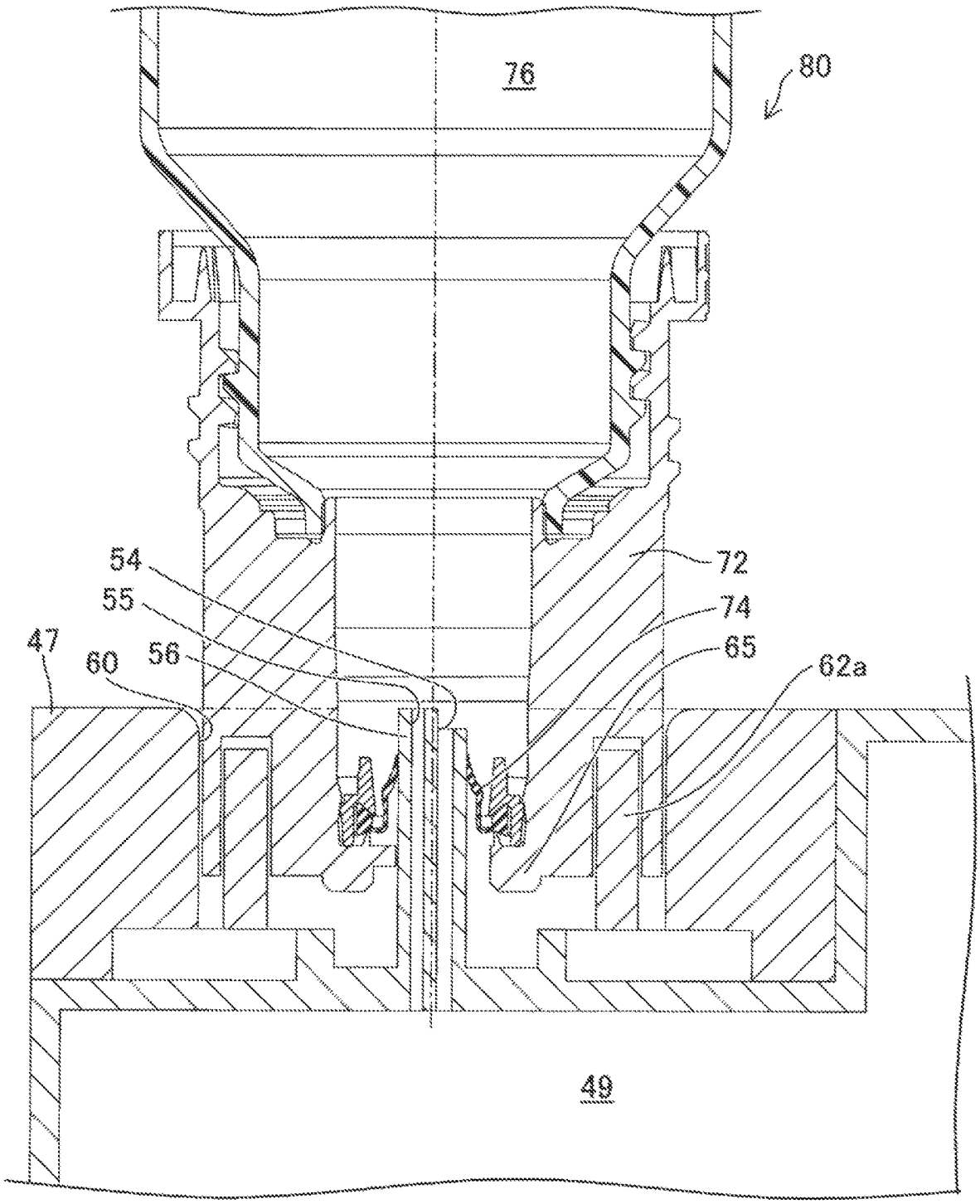
FIG. 9 is a view illustrating the bottle coupled to an ink refill adaptor.
Figure 9:
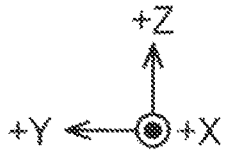

FIG. 9 illustrates the bottle 80 turned upside down and inserted into the ink refill adaptor 47. As described above, the second concave/convex portion 72 of the bottle 80 is shaped to fit the first concave/convex portion 62 for a corresponding ink color. When the color of the ink in the bottle 80 matches the color of ink in the ink tank 41 to be refilled, as illustrated in FIG. 9, the user can put the bottle 80 in the ink refill adaptor 47. This prevents the user from supplying wrong color of ink. The user inserts the bottle 80 until the positioning portion 73 comes in contact with the upper surface of the ink refill adaptor 47. The insertion of the bottle 80 allows the needle 56 to open the slit valve 74. One of the first and second passages 54 and 55 becomes a flow passage of ink and the other becomes a flow passage of air. Of the first and second passages 54 and 55, one that touched ink first at the opening end becomes the flow passage of ink, and one that did not touch the ink becomes the flow passage of air. Opening of the slit valve 74 allows ink in the bottle 80 to flow to the ink tank 41 through the first passage 54 or the second passage 55. After completion of the refill, the user pulls the bottle 80 out of the ink refill adaptor 47 and puts the cap 68 on the bottle 80. When the cap 68 is attached to the bottle 80 as described above, the projection 684 of the cap 68 is moved away from the valve member 742. In FIGS. 3 and 9, the first and second passages 54 and 55 have different heights, but the first and second passages 54 and 55 may have the same height.

According to the above-described embodiment, when the cap 68 is rotated in the first direction in which the engagement between the first and second screw threads 69 and 681 is cancelled, the projection 684 moves to the valve member 742 to push the valve member 742 and enters the slit 75. The projection 684 pushing the valve member 742 releases the pressure from the bottle 80. In contrast, when the cap 68 is rotated in the second direction, in which engagement between the first and second screw threads 69 and 681 is established, the projection 68 is relatively rotated in the first direction to be away from the valve member 742. This reduces creep deformation of the valve member 742, because the projection 684 is positioned away from the valve member 742. Furthermore, the rotation of the cap 68 in the first direction allows the second protrusion 687 to come in contact with the first protrusion 91. This allows the projection 684 to relatively rotate in the second direction and move toward the valve member 742 until the projection 684 pushes the valve member 742 and enters the slit 75. In contrast, the rotation of the cap 68 in the second direction allows the second protrusion 687 to come in contact with the first protrusion 91. This allows the projection 684 to relatively rotate in the first direction to be away from the valve member 742. In this configuration, when the cap 68 is rotated in the first direction relative to the bottle 80, the projection 684 pushes the valve member 742. When the cap 68 is rotated in the second direction relative to the bottle 80, the projection 684 moves away from the valve member 742. Furthermore, the pitch P2 of the third and fourth screw threads 685 and 686 may be larger than the pitch P1 of the first and second screw threads 69 and 681. This makes the movement distance of the projection 684 larger for the rotated amount of the cap 68 than a configuration in which the pitch P2 is equal to or smaller than the pitch P1.

B: Modifications

B1: First Modification

In the above-described embodiment, the first and second screw threads 69 and 681 are right-hand threads, and the third and fourth screw threads 685 and 686 are left-hand threads. However, the first and second screw threads 69 and 681 may be left-hand threads, and the third and fourth screw threads 685 and 686 may be right-hand threads. The first and second screw threads 69 and 681 and the third and fourth screw threads 685 and 686 have inverted screw structures. This enables the projection 684 to move backward and forward by the rotation of the cap 68 relative to the bottle 80.

B2. Second Modification

In the above-described embodiment, the two first protrusions 91 protrude from the ink outlet 65. The first protrusions 91 have two wall surfaces that form a substantially right angle. The shape of the first protrusion 91 may be modified. The first protrusion 91 may have any shape that protrudes from the second inner peripheral portion 65*a* of the ink outlet 65 toward the center axis CX. The projection 684 has the two second protrusions 687. The shapes of the first and second protrusions 91 and 687 are not limited to those in the above-described embodiment. For example, the number of first protrusions 91 and the number of second protrusions 687 each may be one, or the first protrusion 91 and the second protrusion 687 may engage with each other in the vertical direction.

B3: Third Modification

In the above-described embodiment, the projection 684 is moved backward and forward by the rotation of the cap 68 relative to the bottle 80 because the projection 684 is attached to the top portion 683 by engagement between the third screw thread 685 and the fourth screw thread 686. However, the structure for moving the projection 684 backward and forward by the rotation of the cap 68 relative to the bottle 80 is not limited to that in the above-described embodiment. For example, a structure of cam may be employed to convert rotation motion of the cap 68 to reciprocating motion in the direction along the center axis CX.

C: Other Forms

The present disclosure is not limited to the embodiment described above and may be embodied in various forms without departing from the spirit of the disclosure. For example, the present disclosure may be achieved in the forms below. To solve partially or entirely the problems described above or to achieve partially or entirely the effects described above, the technical features of the above-described embodiment may be replaced or combined as appropriate with corresponding technical features of the configurations described below. Furthermore, the technical feature(s) may be eliminated as appropriate if the technical feature(s) are not described as essential in this specification.

(1) According to another aspect of the present disclosure, an ink refill container is provided. The ink refill container includes a bottle configured to store ink and a cap detachably attached to the bottle. The bottle includes: an ink outlet forming portion that has a tubular ink outlet and an outer peripheral portion having a first screw thread; and a valve that includes a valve member formed of an elastic material and disposed in the ink outlet. The valve member is segmented by at least one slit. The cap includes: a tubular trunk that has a first inner peripheral portion having a second screw thread configured to engage with the first screw thread; a top portion that faces the ink outlet with the cap being attached to the bottle; and a projection that extends along a center axis of the trunk. The projection is configured to move toward the valve member until the projection pushes the valve member and enters the slit to open the valve member when the cap is rotated in a first direction in which engagement between the first screw thread and the second screw thread is cancelled. The projection is configured to relatively rotate in the first direction and move away from the valve member to close the valve member when the cap is rotated in a second direction in which engagement between the first screw thread and the second screw thread is established. In this configuration, when the cap is rotated in the first direction relative to the bottle, the projection pushes the valve member. This releases the pressure from the bottle. In contrast, when the cap is rotated in the second direction relative to the bottle, the projection moves away from the valve member. This reduces creep deformation of the valve member.

(2) In the ink refill container having the above-described configuration, the bottle may further have a first protrusion protruding from a second inner peripheral portion of the ink outlet, and the cap may further include a third screw thread on the top portion. The projection may include a side wall having a fourth screw thread configured to engage with the third screw thread; and a second protrusion protruding from the side wall. The projection may be configured to relatively rotate in the second direction and move toward the valve member until the projection pushes the valve member and enters the slit when the second protrusion is brought into contact with the first protrusion by rotation of the cap in the first direction. The projection may be configured to relatively rotate in the first direction to move away from the valve member when the second protrusion is brought into contact with the first protrusion by rotation of the cap in the second direction. In this configuration, when the cap is rotated in the first direction, the second protrusion comes in contact with the first protrusion. The contact allows the projection to relatively rotate in the second direction and to move toward the valve member. When the cap is rotated in the second direction, the second protrusion comes in contact with the first protrusion. The contact allows the projection to rotate in the first direction and to move away from the valve member. In this configuration, when the cap is rotated in the first direction relative to the bottle, the projection pushes the valve member. This releases the pressure from the bottle. Furthermore, when the cap is rotated in the second direction relative to the bottle, the projection is moved away from the valve member. This reduces creep deformation of the valve member.

(3) In the ink refill container having the above-described configuration, a pitch of the third and fourth screw threads may be larger than that of the first and second screw threads. This configuration increases the movement distance of the projection, which corresponds to the rotated amount of the cap, compared with a configuration in which the pitch of the third and fourth screw threads is equal to or smaller than the pitch of the first and second screw threads.

The components in the above-described embodiment, modifications, and forms of this disclosure are not all essential. To solve partially or entirely the problems described above or to achieve partially or entirely the effects described above, one or more of the components may be altered, eliminated, replaced with another component, or the features of the components may be partly eliminated, as appropriate. Furthermore, to solve partially or entirely the problems described above or to achieve partially or entirely the effects described above, a part or all of the technical features of one of the above-described embodiment, modifications, and forms of this disclosure may be combined with a part or all of the technical features of different one of the above-described embodiment, modifications, and forms of this disclosure to form another form of the present disclosure.

D: Another Embodiment

Next, an ink refill container 63A according to another embodiment will be described. Components identical to those in the above-described embodiment are assigned the same reference numerals and are not repeatedly described.

Figure 10:
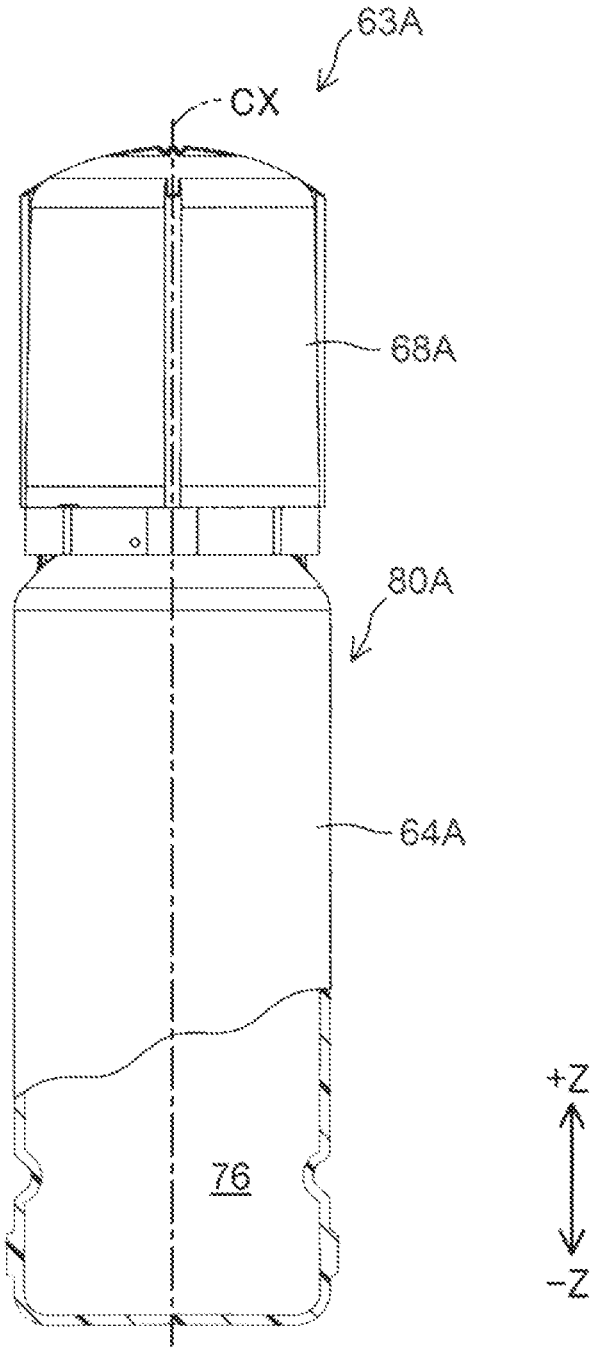
FIG. 10 is a side view of an ink refill container according to another embodiment.
Figure 11:
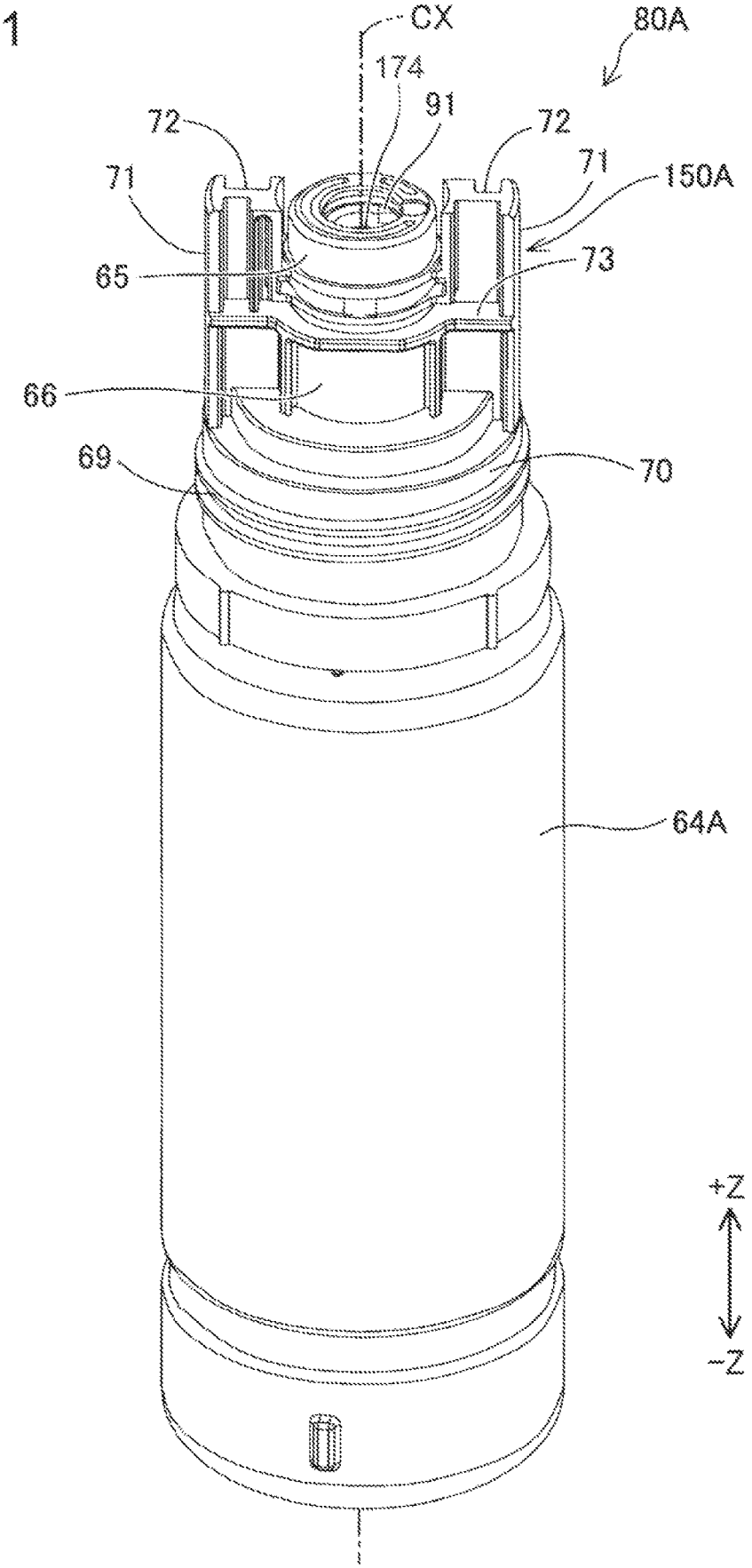
FIG. 11 is a perspective view of a bottle according to another embodiment.

As illustrated in FIG. 10, an ink refill container 63A includes a bottle 80A configured to store ink and a cap 68A detachably attached to the bottle 80A. As illustrated in FIG. 11, the bottle 80A includes a container body 64A and an ink outlet forming portion 150A.

Figure 12:
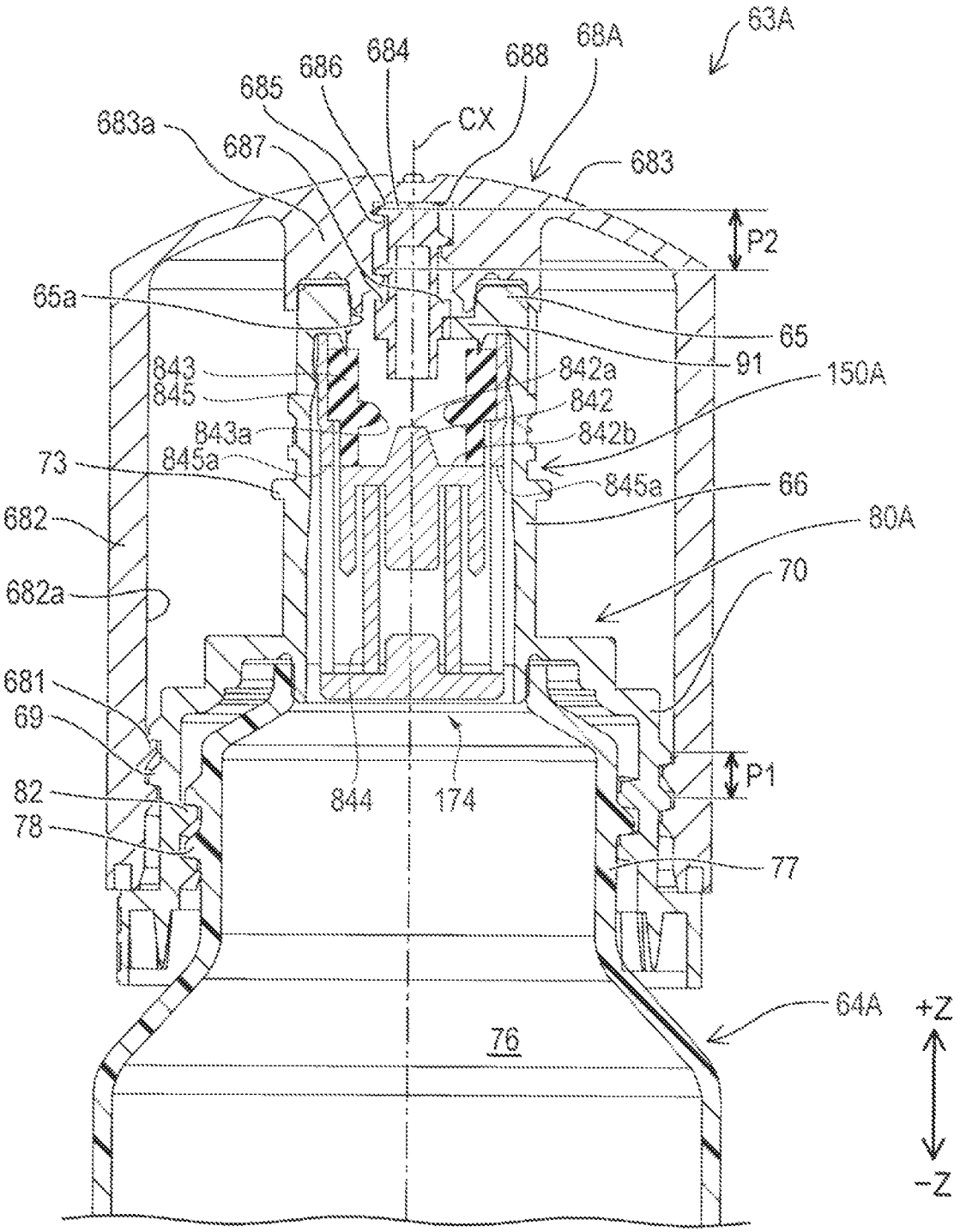
FIG. 12 is a vertical cross-sectional view of a cap and main components of a bottle according to another embodiment.

As illustrated in FIG. 12, the container body 64A has an ink housing 76, a neck 77, and a container screw thread 78. The container body 64A is a container having a tubular shape with a bottom. The inner space of the container body 64A is the ink housing 76 that stores ink.

The ink outlet forming portion 150A covers the neck 77 of the container body 64A and is detachably attached to the container body 64A. The ink outlet forming portion 150A has a substantially hollow cylindrical shape and has an outer peripheral portion 70, a small-diameter portion 66, an ink outlet 65, a spout screw thread 82, a first screw thread 69, a valve 174, and a first protrusion 91.

The valve 174 is disposed in the opening of the ink outlet 65. The valve 174 opens and closes the passage in the ink outlet 65 to control the ink flow. The valve 174 of this embodiment has a valve case 845 having a tubular shape. The valve case 845 is disposed in the opening of the ink outlet 65. A sealing member 843, the valve member 842, and a spring 844 are housed in the valve case 845. The sealing member 843 has a tubular shape and is attached to the inner peripheral portion of the ink outlet 65. The sealing member 843 is formed of an elastic material such as silicone. A protuberance 843*a* protrudes from the inner surface of the sealing member 843 toward the center axis CX. The valve member 842 is located below the sealing member 843 and is configured to move in the Z direction relative to the sealing member 843. Specifically described, the valve member 842 is configured to move to or away from the sealing member 843. The valve member 842 is urged by the spring 844 toward the sealing member 843. The valve case 845 has an opening 845*a* extending in the Z direction in the circumferential surface. The opening 845*a* is a through hole extending through the side wall of the valve case 845 in the radial direction through the center axis CX.

The valve member 842 has a planar portion 842*b* that comes in contact with the sealing member 843. When the surface of the sealing member 843 facing in the −Z direction and the surface of the planar portion 842*b* facing in the +Z direction are in contact with each other, the passage in the ink outlet 65 is closed. When the surface of the sealing member 843 facing in the −Z direction and the surface of the planar portion 842*b* facing in the +Z direction are away from each other, the ink outlet 65 and the ink housing 76 are in communication with each other through the opening 845*a* (atmosphere communication) and the passage of the ink outlet 65 is opened.

The valve member 842 has a protrusion 842*a* protruding from the planar portion 842*b* in the +Z direction. The protrusion 842*a* faces the projection 684. The spring 844 is a coil spring, for example. The end in the −Z direction of the spring 844 is supported by the valve case 845 and the end in the +Z direction of the spring 844 is in contact with the valve member 842 to support the valve member 842. The force of the spring 844 in the +Z direction causes the valve member 842 to come in contact with the sealing member 843, and thus the passage in the ink outlet 65 is closed. The valve member 842 receiving no external force is closed because the sealing member 843 and the valve member 842 are in contact with each other. When an external force is applied to the valve member 842 in the −Z direction, the valve member 842 is moved down in the −Z direction relative to the sealing member 843. Thus, the sealing member 843 and the valve member 842 are away from each other, and thus the valve member 842 is opened.

The cap 68A is detachably attached to the ink outlet forming portion 150A to cover the ink outlet forming portion 150A. The cap 68A has a trunk portion 682, a top portion 683, a top protrusion 683*a*, a projection 684, a second screw thread 681, and a third screw thread 685. The projection 684 is movable backward and forward in the direction along the center axis CX relative to the cap 68A.

When the amount of ink in the ink tank 41 is small, the user refills the ink tank 41 with ink by using the ink refill container 63A. Specifically described, the user removes the cap 68A from the ink refill container 63A to expose the ink outlet forming portion 150A.

Figure 13:
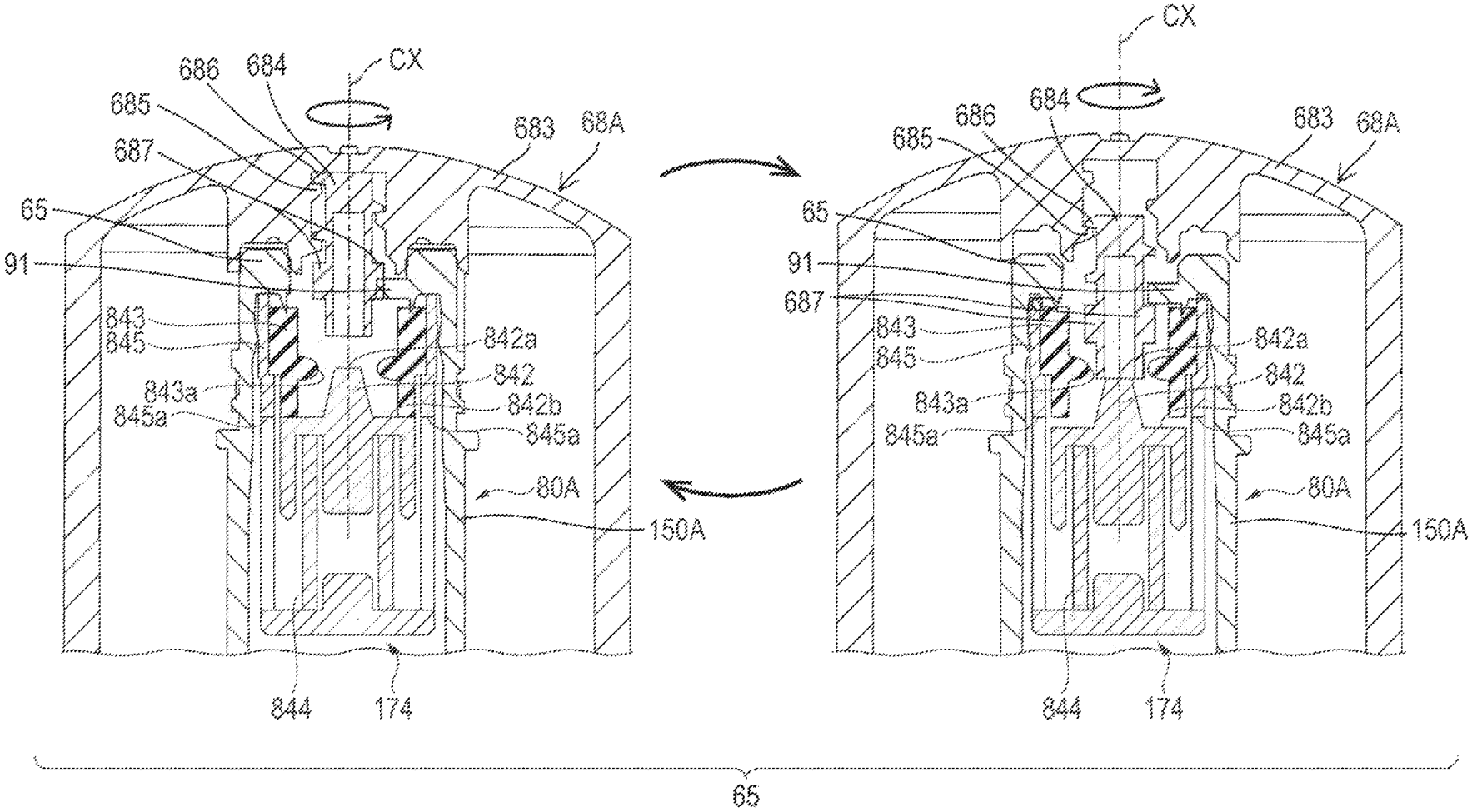
FIG. 13 is a view for explaining a change in position of a projection according to another embodiment.

The movement of the projection 684 during the removal of the cap 68A from the ink refill container 63A is described. FIG. 13 is a view for explaining how the position of the projection 684 relative to the top portion 683 changes when the cap 68A is attached or detached. In the left view in FIG. 13, the cap 68A is attached to the ink outlet forming portion 150A. In the right view in FIG. 13, the cap 68A is unscrewed from the ink outlet forming portion 150A. When the cap 68A screwed to the ink outlet forming portion 150A is rotated relative to the ink outlet forming portion 150A in the counterclockwise direction or the first direction in which the engagement between the first and second screw threads 69 and 681 is cancelled, the first and second screw threads 69 and 681 are disengaged from each other. During the rotation of the cap 68A in the counterclockwise direction, the second protrusion 687 of the projection 684 comes in contact with the first protrusion 91, restricting the rotation of the projection 684 about the center axis CX. Then, the contact between the second protrusion 687 and the first protrusion 91 allows the projection 684 to relatively rotate in the clockwise direction or the second direction opposite to the first direction. The relative rotation moves the projection 684 toward the protrusion 842*a* of the valve member 842, and the projection 684 comes in contact with the protrusion 842*a* to push the protrusion 842*a* (valve member 842) downward (−Z direction). Specifically described, the rotation of the third screw thread 685 in the counterclockwise direction guides the fourth screw thread 686 to the thread groove of the third screw thread 685. This moves the projection 684 toward the valve member 842. Specifically described, as illustrated in the right view in FIG. 13, the projection 684 resists the force of the spring 844 and moves the valve member 842 in the −Z direction. In this state, the valve member 842 and the sealing member 843 are away from each other and the valve 174 is opened through the opening 845*a*. This releases the pressure from the ink container 76.

In contrast, when the cap 68A is rotated relative to the ink outlet forming portion 150A in the clockwise direction or the second direction, in which engagement between the first screw thread 69 and the second screw thread 681 is established, the first screw thread 69 and the second screw thread 681 are engaged. The rotation in the clockwise direction, in which engagement between the first screw thread 69 and the second screw thread 681 is established, allows the second protrusion 687 to come in contact with the first protrusion 91. Thus, the projection 684 is relatively rotated in the first direction to be away from the valve member 842. Since the projection 684 is moved away from the valve member 842, the sealing member 843 comes in contact with the valve member 842 and the valve 174 is closed. As illustrated in the left view in FIG. 13, with the cap 68A being attached, the projection 684 is away from the valve member 842 and the projection 684 does not apply a pressure to the valve member 842. This reduces creep deformation of the valve member 842. If the valve member 842 is subjected to creep deformation, ink may drip from the valve member 842 when the bottle 80A is turned upside down. In this embodiment, the suppression of creep deformation of the valve member 842 reduces the ink dripping from the bottle 80A turned upside down.

In the ink refilling with the ink refill container 63A, after removing the cap 68A from the bottle 80A, the user turns the bottle 80A upside down and puts the exposed convex portions 71 of the bottle 80A in the recess 60 of the ink supply unit 40. At this time, if the inner pressure of the ink container 76 is high and the pressure in the ink container 76 is not sufficiently released, the sum of the inner pressure and the hydraulic head pressure of the ink would exceed the pressure resistance of the valve member 842 when the bottle 80A is turned upside down. In such a case, the ink may spurt. For example, the pressure in the ink refill container 63A increases if the temperature has increased since the last time the cap 68A was being attached. However, in this embodiment, as described above, the projection 684 pushes the valve member 842 and opens the valve 174 to release the pressure from the ink housing 76 when the cap 68A is removed from the bottle 80A. Thus, the ink is unlikely to spurt when the ink refill container 63A is turned upside down.

Figure 14:
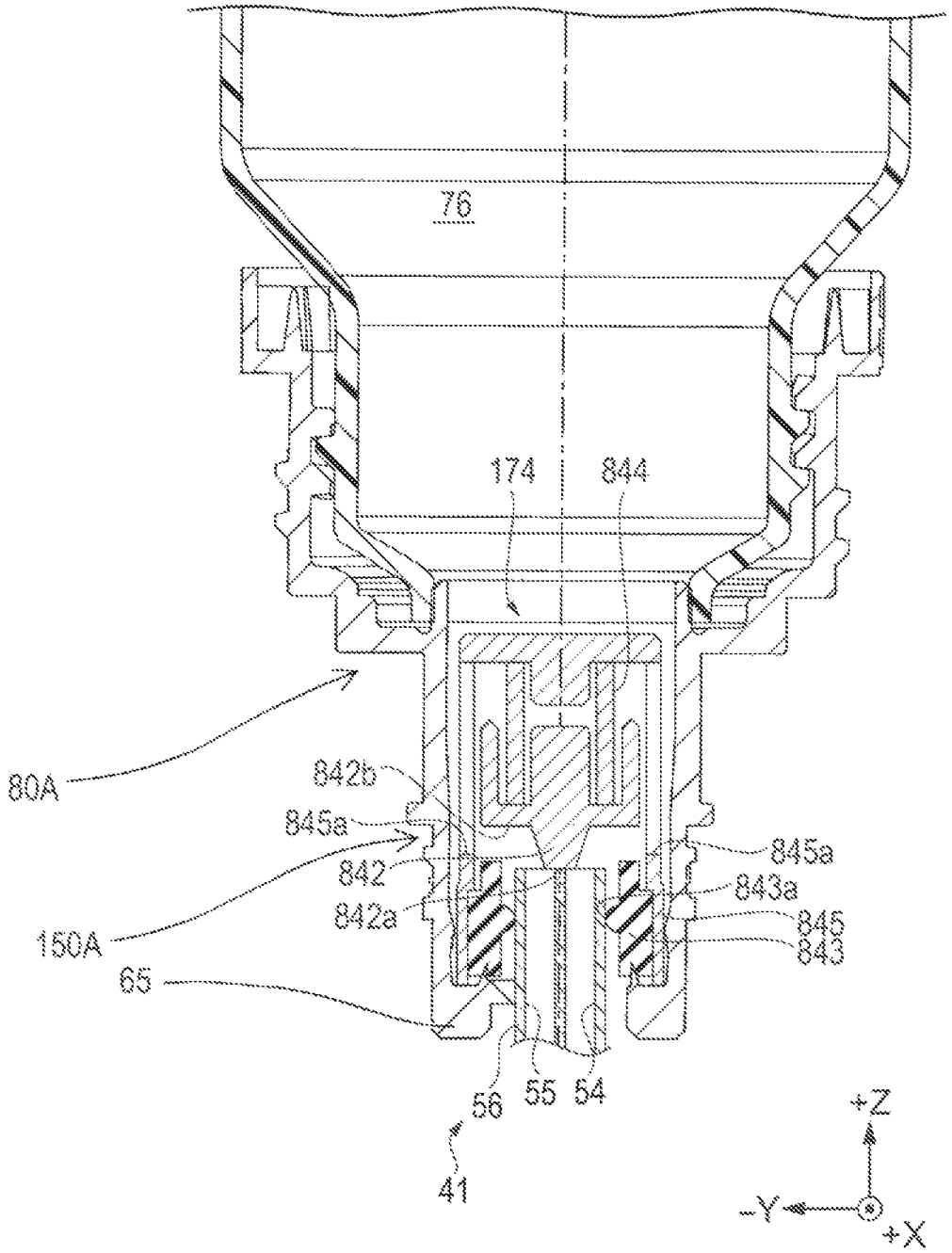
FIG. 14 is a view illustrating a bottle according to another embodiment coupled to an ink refill adaptor.

FIG. 14 illustrates the bottle 80A placed upside down and inserted into the ink tank 41. The insertion of bottle 80A allows the needle 56 to push the valve member 842 and opens the valve 174. One of the first and second passages 54 and 55 becomes the passage of ink, and the other becomes the passage of air. After the valve 174 is opened, the ink in the bottle 80A is supplied to the ink tank 41 through the first passage 54 or the second passage 55. When the bottle 80A is inserted in the ink tank 41, the protuberance 843*a* of the sealing member 843 comes in contact with the outer surface of the needle 56. This keeps the ink outlet 65 closed and prevents the ink leakage. On completion of refilling, the user removes the bottle 80A from the ink tank 41 and puts the cap 68A on the bottle 80A. As described above, when the cap 68A is attached to the bottle 80A, the projection 684 of the cap 68A is moved away from the valve member 842.

According to this embodiment, when the cap 68A is rotated in the first direction, in which the engagement between the first and second screw threads 69 and 681 is cancelled, the projection 684 moves toward the valve member 842 to push the valve member 842 downward. This opens the valve 174 and releases the pressure from the bottle 80A. In contrast, when the cap 68A is rotated in the second direction, in which engagement between the first screw thread 69 and the second screw thread 681 is established, the projection 684 is relatively rotated in the first direction to be away from the valve member 842. This reduces creep deformation of the valve member 842. This configuration is less likely to have the problem of ink leakage through the slit 75, which may be caused by creep deformation, than the configuration including the slit valve 74. Furthermore, in this embodiment, the spring 844 applies a load for a temporary period unlike in the configuration in which the projection 684 of the cap 68A opens the valve 174 all the time. When a stress generated by the load for opening the valve is continuously applied to a portion where the ink is attached, the portion may be readily subjected to chemical cracking. However, the spring load caused during valve opening is only temporary applied, and thus the chemical cracking is likely to be avoided.

In the above-described embodiments of the ink refill containers 63 and 63A, the configurations of the slit valve 74 as the valve and the valve 174 having the spring 844 were described, but the present disclosure is not limited to these configurations. The valve may have any structure that opens and closes in response to the movement of the projection 684. For example, the ink refill container may have any configuration as long as the projection 684 moves toward the valve and pushes the valve member to open the valve when the cap 68 is rotated in the first direction, in which engagement between the first and second screw threads 69 and 681 is cancelled, and the projection 684 is relatively rotated in the first direction to be away from the valve member to close the valve when the cap 68 is rotated in the second direction, in which engagement between the first and second screw threads 69 and 681 is established. With this configuration, when the cap 68 is rotated in the first direction relative to the bottle 80, the projection 684 pushes the valve member, and thus the pressure in the bottle 80 is released. When the cap 68 is rotated in the second direction relative to the bottle 80, the projection 684 moves away from the valve member. This reduces deformation of the valve member or a load continuously applied to a member that opens the valve. In particular, when a stress is continuously applied by a continuous load to a portion where ink is attached, the portion is likely to be subjected to chemical cracking. However, the above-described configurations reduce the possibility.

What is claimed is:

1. An ink refill container comprising:

a bottle configured to store ink; and a cap detachably attached to the bottle, wherein the bottle includes: an ink outlet forming portion that has a tubular ink outlet and an outer peripheral portion having a first screw thread; and a valve that is in the ink outlet and has a valve member, the cap includes: a tubular trunk that has a first inner peripheral portion having a second screw thread configured to engage with the first screw thread; a top portion that faces the ink outlet with the cap being attached to the bottle; and a projection that extends along a center axis of the trunk, the projection is configured to move toward the valve and push the valve member to open the valve when the cap is rotated in a first direction in which engagement between the first screw thread and the second screw thread is cancelled, and the projection is configured to relatively rotate in the first direction and move away from the valve member to close the valve when the cap is rotated in a second direction in which engagement between the first screw thread and the second screw thread is established.

2. The ink refill container according to claim 1, wherein the valve further includes a sealing member in the ink outlet and a spring configured to urge the valve member toward the sealing member.

3. An ink refill container comprising:

a bottle configured to store ink; and a cap detachably attached to the bottle, wherein the bottle includes: an ink outlet forming portion that has a tubular ink outlet and an outer peripheral portion having a first screw thread; and a valve that includes a valve member formed of an elastic material and disposed in the ink outlet, the valve member being segmented by at least one slit, the cap includes: a tubular trunk that has a first inner peripheral portion having a second screw thread configured to engage with the first screw thread; a top portion that faces the ink outlet with the cap being attached to the bottle; and a projection that extends along a center axis of the trunk, the projection is configured to move toward the valve member until the projection pushes the valve member and enters the slit to open the valve member when the cap is rotated in a first direction in which engagement between the first screw thread and the second screw thread is cancelled, and the projection is configured to relatively rotate in the first direction and move away from the valve member to close the valve member when the cap is rotated in a second direction in which engagement between the first screw thread and the second screw thread is established.

4. The ink refill container according to claim 3, wherein the bottle further has a first protrusion protruding from a second inner peripheral portion of the ink outlet, and the cap further includes a third screw thread on the top portion, the projection includes: a side wall having a fourth screw thread configured to engage with the third screw thread; and a second protrusion protruding from the side wall, the projection is configured to relatively rotate in the second direction and move toward the valve member until the projection pushes the valve member and enters the slit when the second protrusion is brought into contact with the first protrusion by rotation of the cap in the first direction, and the projection is configured to relatively rotate in the first direction to move away from the valve member when the second protrusion is brought into contact with the first protrusion by rotation of the cap in the second direction.

5. The ink refill container according to claim 4, wherein a pitch of the third and fourth screw threads is larger than that of the first and second screw threads.

* * * * *